United States Patent [19]

Adams

[11] 3,964,959

[45] June 22, 1976

[54] HEATING STRUCTURE FABRICATING MACHINE AND METHOD

[75] Inventor: Gerald E. Adams, Mishawaka, Ind.

[73] Assignee: Easy Heat-Wirekraft, MSP Industries Corporation, Lakeville, Ind.

[22] Filed: Sept. 6, 1974

[21] Appl. No.: 503,924

[52] U.S. Cl. ..... 156/433; 29/611; 156/177; 156/272; 156/296; 219/213; 219/243; 219/549

[51] Int. Cl.[2] ..... H06B 3/00

[58] Field of Search ..... 156/47, 51, 160–162, 156/166, 175, 176, 177, 178, 180, 181, 272, 274, 275, 296, 298, 306, 391, 433, 434, 436, 439, 440, 441, 583; 219/211–214, 221, 229, 233, 243, 245, 528, 545, 546, 548; 29/610, 611, 6 B; 161/150, 157, 175; 5/347; 428/98, 105, 107

[56] References Cited

UNITED STATES PATENTS

| | | | |
|---|---|---|---|
| 2,749,261 | 6/1956 | Hardison | 156/47 |
| 3,066,063 | 11/1962 | Ecklund et al. | 156/244 |
| 3,191,005 | 6/1965 | Cox | 156/275 |
| 3,209,128 | 9/1965 | Chapman | 219/213 |
| 3,316,134 | 4/1967 | Durakis et al. | 156/47 |
| 3,342,659 | 9/1967 | Baum et al. | 156/296 |
| 3,659,338 | 5/1972 | McFarlane | 219/213 |
| 3,807,044 | 4/1974 | Ziemek | 156/177 |
| R26,374 | 4/1968 | Beery | 156/306 |

*Primary Examiner*—William A. Powell
*Assistant Examiner*—John E. Kittle
*Attorney, Agent, or Firm*—Hobbs & Green

[57] ABSTRACT

A machine for fabricating heating structures having heating wires with an external layer of thermoplastic material arranged with sections in a predetermined pattern, and carrier strands of thermoplastic material fused to and interconnecting the wire sections. The machine includes a wire support means having laterally spaced pegs or the like on which the wire is retained in a predetermined configuration on a substantially common plane. A heating unit or units simultaneously heat the carrier strands and wire sections together. The heating elements and wire configuration are moved relative to one another to join progressively the strands to the transversely arranged heating wire sections. The element used in the heating unit includes a guide trough for the carrier strands and simultaneously heats facing surfaces of the strands and heating wire so that the two can be pressed together while fused to form the bond. The invention also includes the method having the steps of heating the strands and heating wire and pressing the two together, while the two have facing fused areas, to form a bond between the strands and the heating wire.

11 Claims, 7 Drawing Figures

Fig. 5
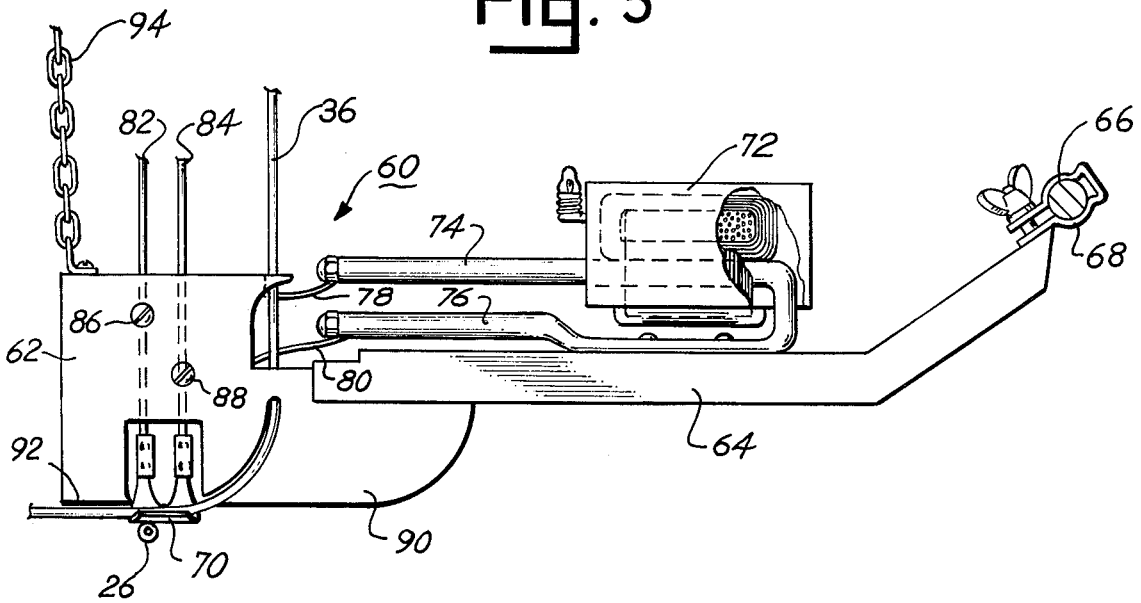
Fig. 6
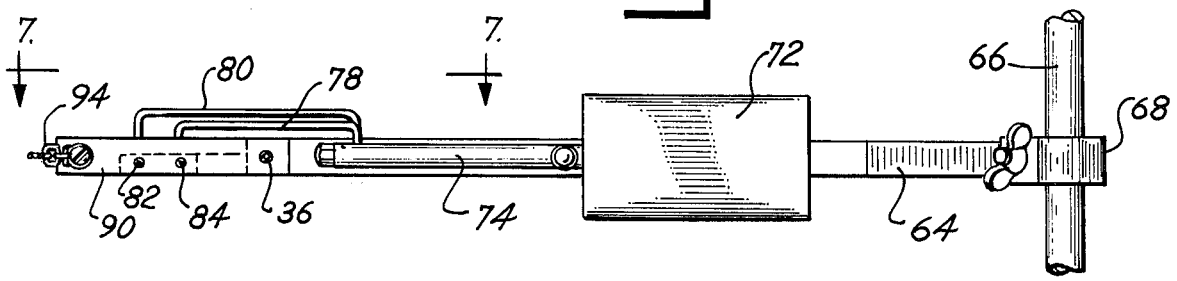
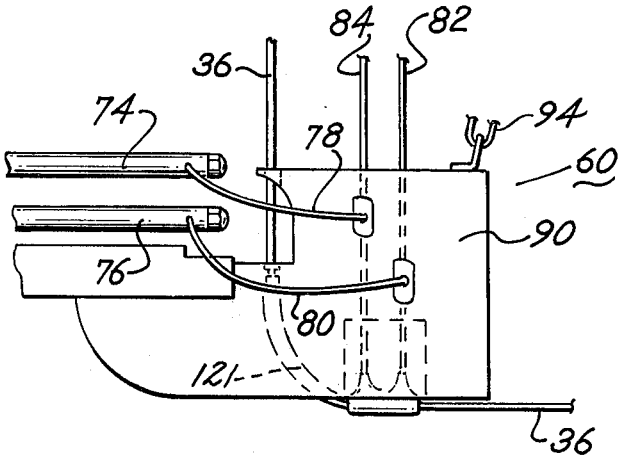
Fig. 7

HEATING STRUCTURE FABRICATING MACHINE AND METHOD

Heating structures and mats for embedment in pavement, walks, steps and ramps and in the earth or fill dirt beneath concrete floors or other types of pavement, have been constructed by a variety of different methods and with different types of structural characteristics. A well known and widely used type consists of securing resistance heating wire to metal wire mesh using clips or the like to secure the heating wire in a predetermined pattern to one side of the wire mesh, and another type consists of a layer of plastic mesh on which the heating wire is mounted and secured by fusing the plastic strands of the mesh with the plastic insulation of the heating wire, by physically securing the wire to the plastic mesh by pressing the outer layer of insulation of the heating wire into gripping relationship with the strands of the mesh, or by using an adhesive disposed between the heating wire and mesh strands, or using two layers of mesh with the heating wire disposed between and held in place by the intermittent fusion of the two layers. These prior structures and methods have had certain inherent disadvantages and difficulties which have rendered them unsatisfactory and/or uneconomical to make, install or operate. More recently a heating structure has been invented consisting of an electrical resistance heating wire having a thermoplastic coating and being arranged in a predetermined circuitous pattern, and several strands of thermoplastic laid, usually in straight lines, from one section of the heating wire to the other, and joined to the heating wire by the application of heat, thereby holding the wire in its predetermined pattern. This structure and method are not only simple in construction and efficient to operate but easy and economical to fabricate, store, ship and install. It is one of the principal objects of the present invention to provide a machine for producing this latter heating structure which will produce this type of structure rapidly, simply and economically, and which is easy to operate without requiring any special training or skills.

Another object of the invention is to provide a heating structure fabricating machine which is simple in construction and capable of producing a structure of any desired length, and which can be adapted to produce heating structures of the aforesaid type with various predetermined heating wire configurations and with different numbers of holding strands for the wire sections.

A further object of the invention is to provide a machine for producing heating structures of the foregoing recently developed type having heating wire with thermoplastic insulation and strands of thermoplastic material, which will automatically apply the required heat and pressure to the strands and wire to bond the two together after the wire has been arranged in a predetermined pattern, and which operates effectively to join the wire and strands, notwithstanding variations in pattern made in the heating structure while being fabricated.

Additional objects and advantages of the present invention will become apparent from the following description and accompanying drawings, wherein:

FIG. 5 is an enlarged side elevational view of a heating unit used in the machine;

FIG. 6 is a top plan view of the heating unit shown in FIG. 5; and

FIG. 7 is a fragmentary side elevational view of the side of the unit opposite that shown in FIG. 5.

Figure 1:
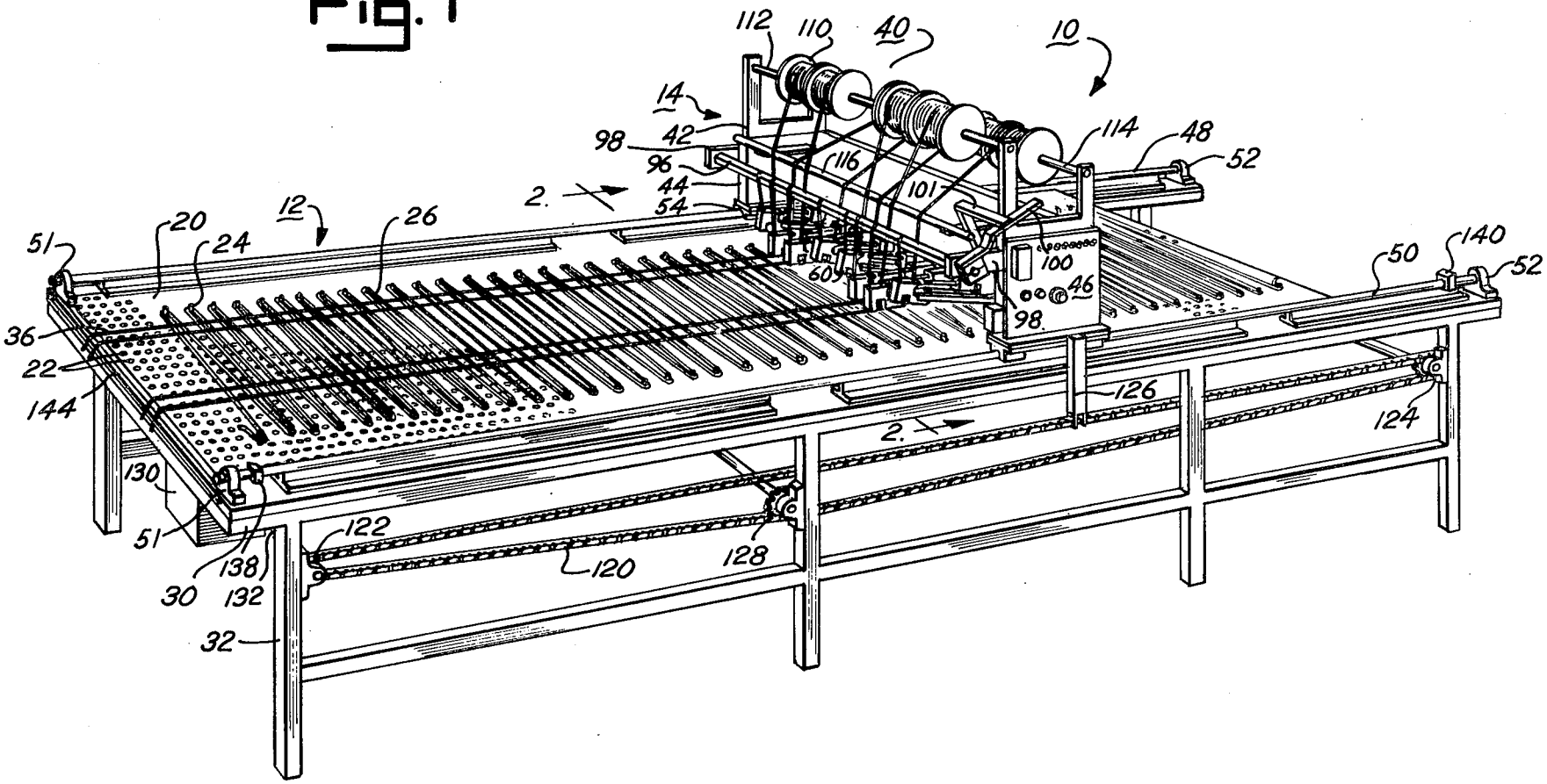
FIG. 1 is a perspective view of a heating structure fabricating machine embodying the present invention.
Figure 2:
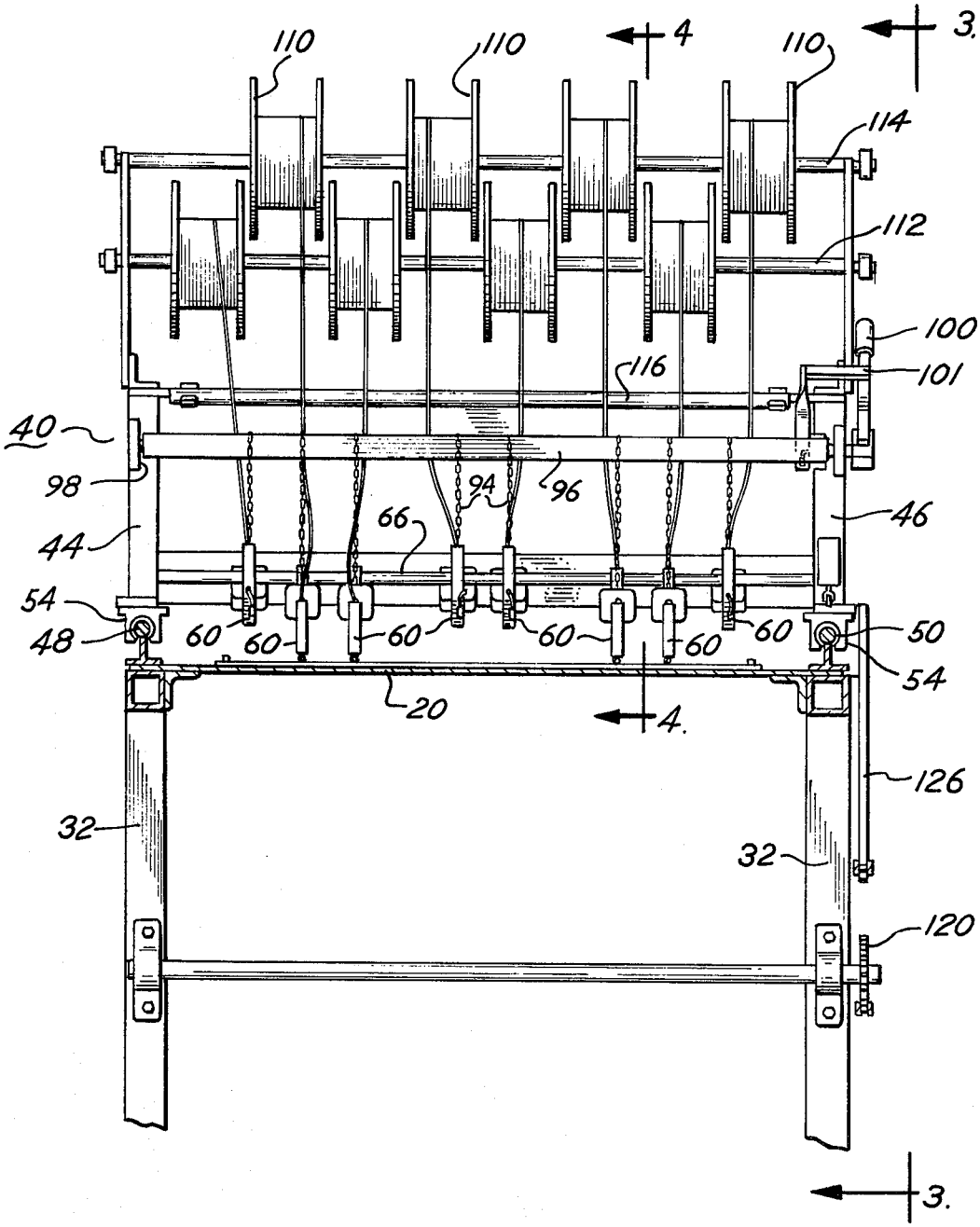
FIG. 2 is a vertical cross sectional view through the machine, the section being taken on line 2 — 2 of FIG. 1.
Figure 3:
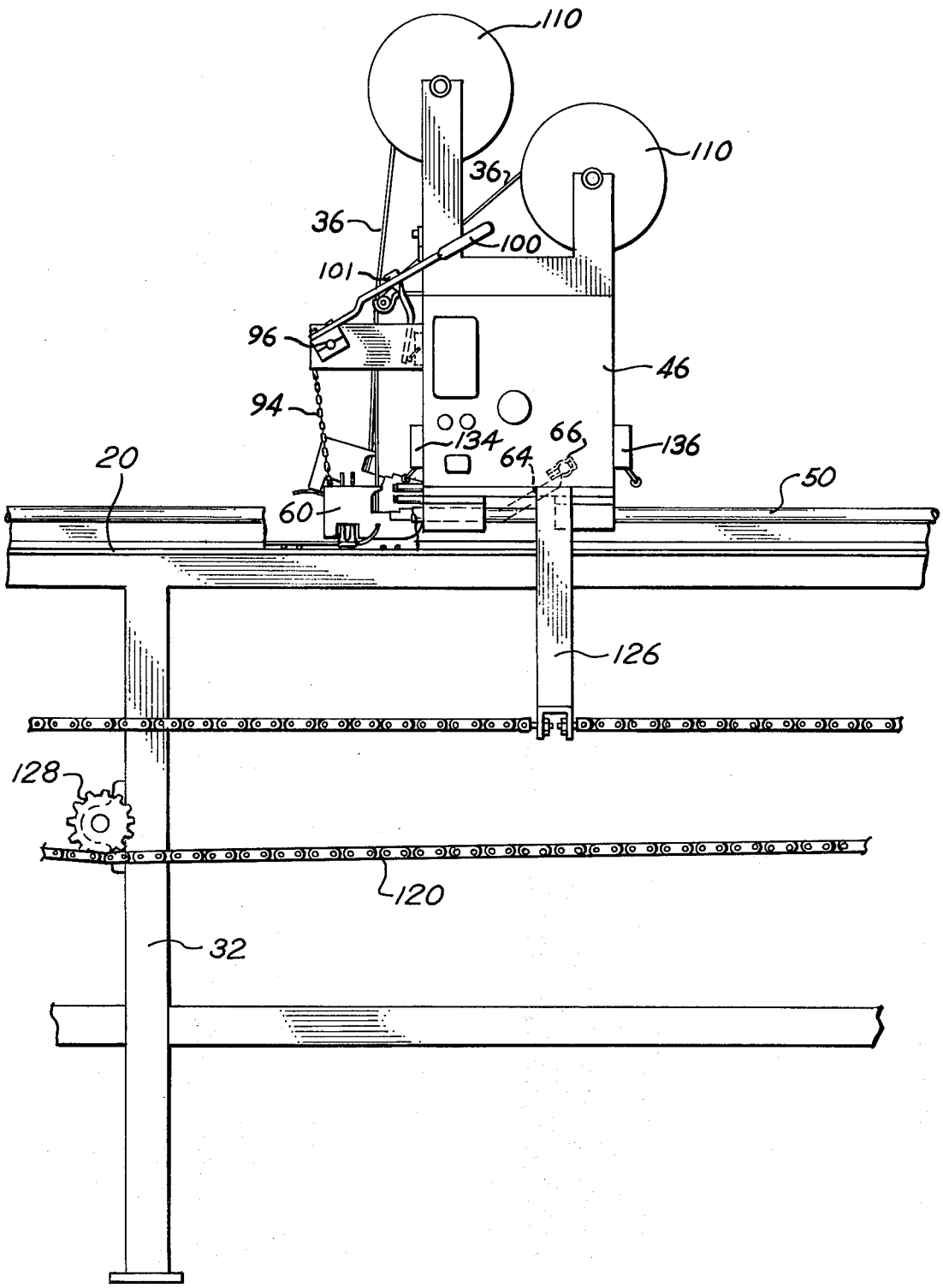
FIG. 3 is a fragmentary side elevational view of the machine, as viewed from the line indicated by numerals 3 — 3 of FIG. 2.
Figure 4:
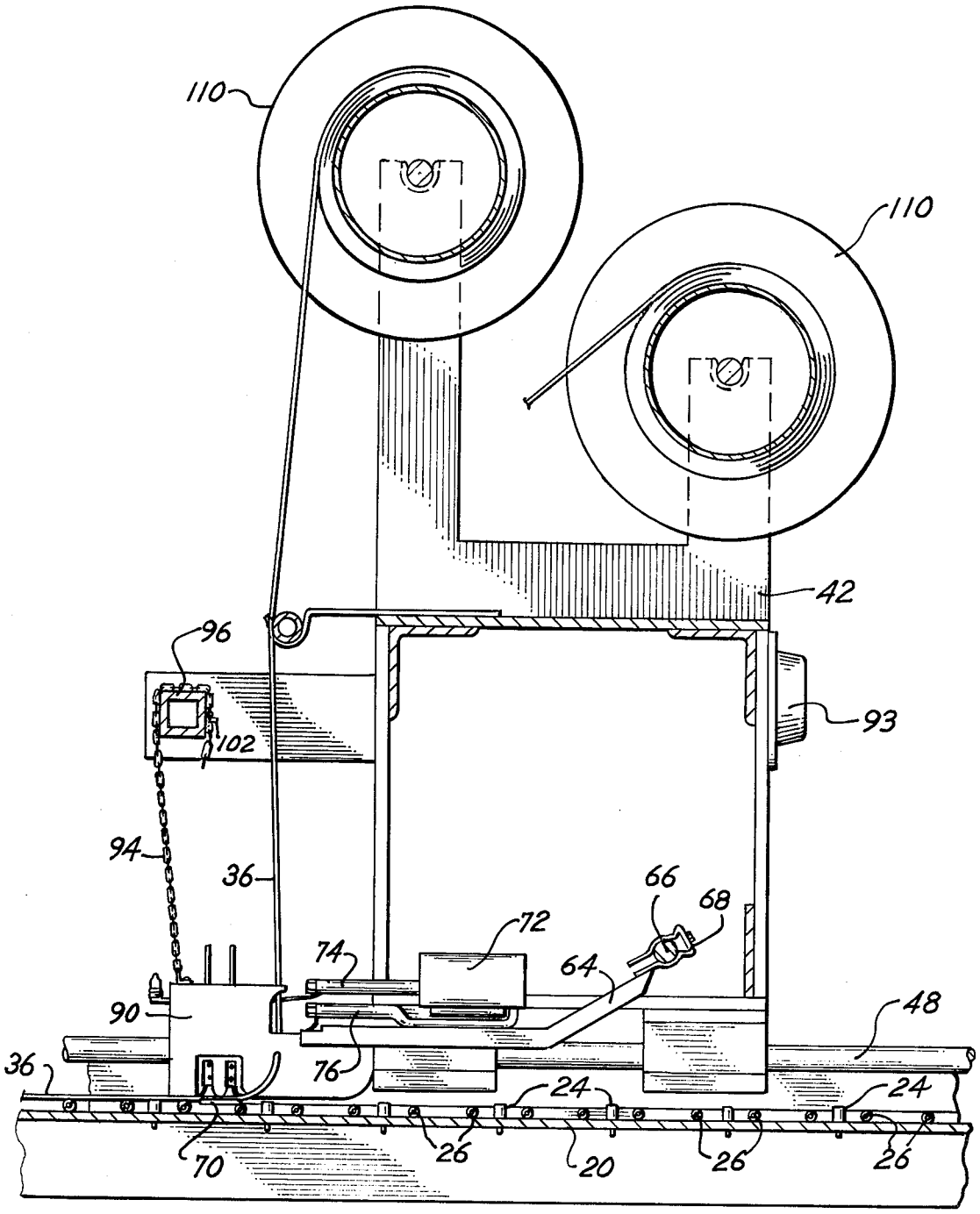
FIG. 4 is a fragmentary vertical cross sectional view of the machine, the section being taken on line 4 — 4 of FIG. 2.

Referring more specifically to the drawings and to FIG. 1 in particular, numeral 10 indicates generally the heating structure fabricating machine embodying the present invention, numeral 12 designates a table on which the heating structure is fabricated and 14 a carriage for heating units used in the fabrication of the heating structure. The type of heating structure fabricated on the present machine is disclosed in my copending application Ser. No. 483,226 filed June 26, 1974, now U.S. Pat. No. 3,904,847, issued September 9, 1975, the heating structure consisting generally of an electrical resistance heating wire having an insulation of thermoplastic material and being placed in a predetermined pattern such as the serpentine pattern shown in FIG. 1. The transverse sections of the heating wire are held in their predetermined pattern by carrier strands of thermoplastic material joined to the surface of the heating wire, thus forming a flexible structure which can be rolled, folded or otherwise shaped to the contour of the driveway, floor, steps or other pavement or material in which the unit is embedded. The heating structure of this type is used primarily for heating concrete floors by placing the units in the earth beneath the floor or in a pavement for a driveway, walk or in step structures. When the electrical resistance wire is energized, it produces sufficient heat to maintain the concrete floor or driveway at the desired temperature. When the heating structure is in the floor it is intended primarily as a source of heat for heating the space above the floor. When the structure is placed in the driveway, walk or steps it is primarily intended to maintain the temperature above freezing to melt snow and to prevent the formation of ice thereon. The heating structure or mat formed by the present fabricating machine may be of various shapes and have transverse sections of the heating wire of different lengths forming, in effect, cut out sections for adapting the heating structure to the structure of the building or driveway in which it is installed, thus providing, for example, a "cut out" section for the space occupied by conduits, plumbing, posts and the like. Various configurations can be made to adapt the structure to the intended use.

In the embodiment of the present heating structure fabricating machine shown in the drawings, table 12 consists of a stationary top 20 having numerous spaced holes 22 in which pegs 24 are arranged in a desired pattern for receiving and holding the sections of heating wire identified by numeral 26. The heating wire is continuous from one end of the table to the other and is looped back and forth around the pegs on opposite sides of the table without overlapping any of the sections. The holes in the table permit the arrangement of pegs inwardly or outwardly to provide "cut out" portions or lateral extensions when the heating unit is being manufactured for a specific installation. However, when the heating element is being made for general use, the pegs are arranged in two lateral spaced straight rows, thus providing a final heating structure of a rectangular configuration. The table top may be of pressed wood, plywood or metal, which ever is desired, and is mounted rigidly on a table frame 30 having a plurality of legs 32 along each side of such a length that the table top is approximately the same as that for a conventional table, thus permitting the operator of the machine to loop conveniently the heating wire around the pegs to form the desired configuration. The wire used in the construction of the heating structure requires a thermoplastic outer layer; however, the remainder of the layer may be of any desired composition and structure.

The carrier strands 36 which hold the sections of wire 26 in the desired configuration are applied to the heating wire strung on the table by the operation of carriage 40, the carriage consisting of a frame 42 having end plates 44 and 46 which are mounted on rails 48 and 50, respectively. The rails are supported at their ends by brackets 51 and 52 on the corners of the table. In the embodiment illustrated, the rails are round rods and bearings 54 are secured to the bottom of plates 44 and 46 and glide on the rods, thereby permitting the carriage to move freely from one end of the table to the other. The carrier strands 36 are applied by heating units or guns 60 which are mounted on the carriage between side plates 44 and 46, each consisting of a head 62 supported by an arm 64 which in turn is supported by a rod 66 extending between the two plates 44 and 46, the arm being secured to the rod by a fixture 68. The carrier strand is heated by an electrical heating element 70 connected to a transformer 72 mounted on arm 64 and connected to the element by rods 74 and 76 and wires 78 and 80 and rods 82 and 84, the two wires being connected to the rods 82 and 84 by screws 86 and 88, respectively. The two rods 82 and 84 are connected to element 70, thus completing the circuit through the transformer to the element. The transformer provides a low voltage high current for heating the element 70 sufficiently to fuse the outer surface of the carrier strand 36 and the adjacent section of heating wire 26. The body 90 of unit 60 is preferably constructed of plastic and is provided with a smooth bottom surface 92 which contacts the upper surface of carrier strand 36 and presses it into the fused surface of the heating wire, as the unit moves over the heating wire. The weight of the body and the heating components mounted on arm 64 provide sufficient pressure to effectively join the carrier strands and heating wire. Each of the transformers 72 controlled by knobs 93 has a variable transformer (not shown) on the carriage to vary the temperature of the elements in accordance with the speed of the carriage relative to the table top.

In the embodiment of the invention illustrated in the drawings, eight heating units are mounted on the carriage, and are supported in operating position by a chain 94 connected to an operating bar 96 pivotally mounted in brackets 98 and operated by a handle 100 and latch 101. When the handle is pressed downwardly as viewed in FIG. 1, rod 96 is rotated, thereby winding chain 94 thereon sufficiently to lift the heads of the heating units from the heating wire on the table. While eight heating units are shown on the carriage, often only four of the heads may be used at any one time. In order to render the heads inoperative and prevent them from interfering with fabrication of the structure, they are lifted by shortening respective chains 94, using pin 102 to select a required link in the chain. While normally four carrier strands are adequate to form an effective heating structure, there may be some installations in which all eight of the heads may be used, or it is possible that in some installations, a greater number of carrier strands would be desirable. The carriage can be moved over the heating wire a second time to secure additional strands to the wire sections.

The carrier strands are on spools 110, one spool being used for each heating unit, and the spools are mounted on rods 112 and 114 which are supported at their ends by vertical extension members of frame 42. As the strands leave the spools, they pass over a rod 116 and enter the head 62 of the heating unit through a channel 121 and pass along in contact with the upper surface of the trough-shaped element 70. The lower surface of the element contacts the heating wire, thereby permitting the element to simultaneously heat the lower surface of the carrier strands and the upper surface of the heating wire. Thus, as the head moves away from the heating wire section, i.e., toward the right as viewed in the drawings, the heated carrier strand immdediately contacts the fused area of the heating wire and is pressed firmly in contact therewith by the weight of body 90, thus causing the fused surfaces of the strand to contact the fused surface of the heating wire and to join the two together. The thermoplastic layer on the strand and heating wire cool and solidify rapidly, thereby forming an effective joint immediately after the strand leaves element 70 as the carriage moves toward the right on rails 48 and 50. The carrier strands 36 may be merely of thermoplastic material; however, they preferably contain a metal wire or fiberglass core to prevent stretch of the strand.

The carriage is driven along the table from one end to the other end by a drive consisting of a chain 120 trained on sprockets 122 and 124 mounted on legs 32 at opposite ends of the table. The chain is connected to the carriage by an arm 126 which is rigidly connected to the carriage and pivotally connected to the chain. An idle sprocket 128 is preferably provided to maintain the proper tension on the chain. A motor and gear reduction unit in a housing 130 are mounted on the underside of the table top and connected to sprocket 122 by a shaft 132. The motor is reversible, thereby permitting the carriage to be driven readily in either direction from one end of the table top to the other. Limit switches 134 and 136 are provided on opposite sides of the carriage and are operated on cams 138 and 140 mounted on opposite ends of track 50. These switches, which are in the drive motor control circuitry, stop the carriage when it has reached either of the two ends. The speed of the carriage may be variable by a suitable variable transformer and control for the drive motor. Controls for the various heating units are mounted on plate 46 and, while the control for the motor may likewise be mounted on the carriage, it may be located at any other convenient place.

In the operation of the heating structure fabricating machine just described, carriage 40 is moved to the far right as viewed in the drawings, thus fully exposing the table top, since the table top does not extend fully to the right hand of the table. After the pegs have been placed in the position to give the desired heating structure configuration, the heating wire is looped back and forth over the pegs to provide a pattern such as that shown in FIG. 1. Several pegs may be spaced inwardly or outwardly from the row if desired to provide either an indentation or an extension in the final heating structure. After the wire has been placed in the preferred configuration, from one end of the table to the other or in a shorter length if desired, the carriage 40 is moved by the motor driving chain 120 to the left hand end of the table. Four strands on the carriage are threaded through the head and element 70 and then fastened at the end of the table. In this embodiment, a coiled wire spring 144 is used to hold the ends of the carrier strands. While the ends of the strands are held in this manner, the carriage is moved by the motor along rails 48 and 50 toward the right hand end of the table. As the carriage moves, elements 70 heat the strands as the strands move downwardly through channels 121 and through the trough on the upper surface of the elements. The elements, being hot, fuse the lower surface of the carrier strands and simultaneously fuse a small area of the upper surface of the heating wire. As soon as the carriage has moved sufficiently to the right to pass away from the particular heating wire section, the fused areas of the strands and heating wire are passed together by the surface 92 of the body 90, causing the fused areas to adhere to one another. Upon cooling, which occurs readily after the heating unit has passed beyond the heating wire, the strands are firmly secured to the heating wire. After the carriage arrives at the right hand end of the table, lever 100 is pressed downwardly and locked into position by latch 101, thus lifting the heads of the heating units and holding them in spaced relation to the heating structure. The heating structure is then removed from the table as a unit and the heating wire is again strung on the pegs preparatory to the fabrication of a second heating structure.

While the machine is shown as having a movable carriage and a stationary table on which the heating wire is placed, the carriage may be stationary and the table top consist of an endless belt mounted on rollers or pulleys at each end of the table with the pegs arranged thereon in a manner similar to that used on the flat table top 20. In the use of this modified form, the heating wire can be placed on the pegs as the endless belt rotates, and the carrier strands are attached to the heating wire as the wire sections pass beneath the heating units, thus resulting in a continuous operation for fabricating the heating structures. In this continuous operation, the heating structures are cut into sections of the desired length as they emerge completed at the left hand end of the machine. Various other modifications and changes may be made to satisfy requirements.

I claim:

1. A machine for fabricating heating structures having heating wires with an external layer of thermoplastic material arranged with sections in a predetermined pattern and carrier strands of thermoplastic material fused to and interconnecting said wire sections: comprising a heating wire support means having spaced members on which wire sections are retained in a predetermined configuration and on a substantially common plane, a means for feeding a strand in a relatively cool condition to a heating wire section at said common plane and in a direction generally transverse to said wire section, a heating unit for simultaneously fusing a surface of said strand and an adjacent surface on said wire section in a transverse path, for immediate contact and union between said strand and said wire section in said path at said heated surface and progressively from one spaced section to another, a support means for said heating unit, and means for moving said heating unit and said wire support means relative to one another to join successive sections of said heating wire with said strand.

2. A machine for fabricating heating structures as defined in claim 1 in which there are a plurality of heating units for simultaneously fusing the surface of the strand and the adjacent surface on said wire sections and progressively from one section to another, said plurality of heating units being supported by said support means.

3. A machine for fabricating heating structures as defined in claim 1 in which said support means for said heating unit is a carriage and said heating wire support means is a table and said table and carriage move relative to one another when the operation of joining the carrier strand and heating wire is performed.

4. A machine for fabricating heating structures as defined in claim 2 in which said support means for said heating units is a carriage and said heating wire support means is a table and said table and carriage move relative to one another when the operation of joining the carrier strands and heating wire is performed.

5. A machine for fabricating heating structures as defined in claim 1 in which the strand is wound on a spool and the spool is supported by said support means.

6. A machine for fabricating heating structures as defined in claim 4 in which said strands are wound on spools and said spools are supported on said carriage.

7. A machine for fabricating heating structures as defined in claim 2 in which each of said heating units has a body which supports said element and has a surface which contacts the strand to apply a force for assisting in joining the two fused surfaces.

8. A machine for fabricating heating structures as defined in claim 2 in which said units may be selectively used and a means is provided for lifting the units from the heating wire supporting means when the machine is inoperable so that the units may be moved relative to the heating wire supporting structure without contacting the heating wire thereon.

9. A heating element for connecting in crossed relationship a heating wire and a strand, each having an outer surface of thermoplastic material: comprising a surface for contact with the heating wire and a surface for contact with the strand in a path transverse thereto, means for heating said surfaces simultaneously, and means for guiding said wire and strand into contact with one another along said transverse path after said surfaces have been fused by the heat from said element to form a bond therebetween.

10. A heating element as defined in claim 7 in which a trough is provided on one side for the strand and a smooth surface on another side for the wire for simultaneously heating the carrier strand and heating wire, respectively.

11. A heating element as defined in claim 10 in which said element is supported by a body and said body has a surface for pressing the strand and wire together to assist in forming an effective bond while the surfaces of the strand and wire are in a fused condition.

* * * * *